United States Patent [19]

Reiner et al.

[11] Patent Number: 4,565,603

[45] Date of Patent: Jan. 21, 1986

[54] METHOD AND DEVICE FOR REDUCING DISTURBANCES DURING PAPER WEB FORMATION

[75] Inventors: Per L. Reiner, Matfors; Sven U. T. Åberg, Mölnlycke, both of Sweden

[73] Assignee: Molnlycke Aktiebolag, Gothenburg, Sweden

[21] Appl. No.: 615,667

[22] Filed: May 31, 1984

Related U.S. Application Data

[63] Continuation of Ser. No. 412,965, Aug. 30, 1982, abandoned, which is a continuation of Ser. No. 220,029, Dec. 1, 1980, abandoned.

[30] Foreign Application Priority Data

May 23, 1979 [SE] Sweden ..... 7904555
May 20, 1980 [WO] PCT Int'l Appl. ... PCT/SE/8000145

[51] Int. Cl.[4] ..... D21F 1/02

[52] U.S. Cl. ..... 162/123; 162/212; 162/216; 162/336; 162/343; 162/344; 162/350; 162/351

[58] Field of Search ..... 162/123, 212, 214, 216, 162/299, 336, 343, 344, 347, 350, 300, 351

[56] References Cited

U.S. PATENT DOCUMENTS

| | | | |
|---|---|---|---|
| 2,345,647 | 4/1944 | Witham | 162/351 X |
| 2,859,668 | 11/1958 | Berlyn | 162/336 X |
| 3,072,180 | 1/1963 | Jodney | 162/347 X |
| 3,079,990 | 3/1963 | Taylor et al. | 162/350 |
| 3,937,273 | 2/1976 | Radvan et al. | 162/212 |
| 3,972,771 | 8/1976 | Notbohm | 162/343 |
| 4,050,499 | 9/1977 | Luey et al. | 162/347 |
| 4,125,429 | 11/1978 | Hergert et al. | 162/123 |
| 4,141,788 | 2/1979 | Justus | 162/216 |
| 4,345,970 | 8/1982 | Radvan et al. | 162/344 |

FOREIGN PATENT DOCUMENTS 349076 9/1972 Sweden .

*Primary Examiner*—S. Leon Bashore
*Assistant Examiner*—K. M. Hastings
*Attorney, Agent, or Firm*—Lerner, David, Littenberg, Krumholz & Mentlik

[57] ABSTRACT

A method and apparatus for forming a paper web from a fiber suspension are disclosed. These include injecting a fiber suspension stream through a slice opening onto the upper surface of a travelling paper web-forming surface, maintaining that surface free of support for a predetermined distance downstream of the slice opening, maintaining a flexible lip near the upper surface of the web-forming surface for a portion of that predetermined distance, and applying a vacuum to the lower surface of the web-forming surface throughout the predetermined distance. In this manner, both the method and apparatus can produce a paper web and substantially dewater the fiber suspension within the space between the flexible lip and the web-forming suspension and substantially reduce disturbances during formation of the web and throughout the predetermined distance.

9 Claims, 5 Drawing Figures

METHOD AND DEVICE FOR REDUCING DISTURBANCES DURING PAPER WEB FORMATION

This is a continuation of application Ser. No. 412,965, filed on 8/30/82, now abandoned, which is a continuation of application Ser. No. 220,029, filed on Dec. 1, 1980; now abandoned.

FIELD OF THE INVENTION

The present invention relates to methods for forming a paper web in a fourdrinier paper making machine. More particularly, the present invention relates to methods for forming paper webs in such machines while avoiding disturbances during such formation. The present invention also relates to apparatus for forming a paper web in such paper making machines.

BACKGROUND OF THE INVENTION

During the formation of paper from a pulp suspension it is of extreme importance from the point of view of the properties of the paper being produced that the paper web be formed in the wet section of the machine under controlled conditions.

Normally, the stock is ejected in the form of a free jet from the head box onto the wire, where the stock is dewatered and a paper web is formed. Formation of the web is influenced by many different potentially disturbing factors, such as e.g. incomplete dispersion of the fibers in the stock, non-uniform flow of the pulp out of the head box, differences in rate between the pulp jet and the wire, non-uniform dewatering due to unsuitable or deficient dewatering members, etc. It is particularly difficult to cope with the first two of these noted disturbing factors.

For geometrical-mechanical reasons, the fibers have a tendency to flocculate. This tendency towards flocculation is accentuated in connection with increasing fiber concentrations and fiber lengths. In order to be able to make a paper having a good formation, the fiber flocks must be well dispersed in the stock. This can be achieved by a very low fiber concentration, but in most cases that is not attractive, generally because it thus necessarily requires the handling of large amounts of flow. A degradation of the fiber flocks can also be effected by means of a fine turbulence in the stock flow. Machine manufacturers, therefore, have tried to establish flow geometries in the head box which yield a low-scale turbulence of sufficient intensity.

Based upon experience gained in practical operation, however, it is realized that this has created a dilemma. The turbulence thus generated often has a relatively wide spectrum, i.e. turbulence of relatively high scale mixed with turbulence of relatively low-scale. While the low-scale turbulence decays rapidly, and thereby gives rise to rapid re-flocking, the large whirls, which are rich in energy, have a longer duration, and thus often participate in the flow out of the head box. When the turbulence level in the jet ejected from the head box is too high, a change of the jet geometry (which originally is determined by the geometry of the slice) then results. The thickness of the stock jet shows local variations in time and geometry across the machine. As the substance of the sheet being formed depends upon the thickness of the stock layer across the wire, this substance thus varies from one position in the paper web to another.

These problems, which often relate to insufficient deflocculation of the stock, since the necessary turbulence level would unacceptably disturb the web formation on the wire, become considerably more serious in a fourdrinier machine than on a double-wire machine. On the latter machine, the free jet length is generally short, and dewatering takes place rapidly, so that thickness variations in the stock layer do not have sufficient time to grow to the same extent as they would in a fourdrinier machine.

Dewatering to a fixed state of the individual fibers in a fiber bed on a fourdrinier machine is carried out by different types of dewatering members, forming tables, table rolls, foils, and web suction boxes. In addition to their primary objective of dewatering, each of these members has a common element in that, to greater or lesser extents, they introduce disturbances into the stock layer. Dewatering by means of foils may thus be seen as an example of same. Foil strips are positioned at a predetermined angle relative to the wire, so as to form a diverging space with the wire in the direction of the machine. When the wire with the stock layer moves rapidly over the strip, a vacuum is formed in the diverging space, which brings about the dewatering. Greater or lesser amounts of the drained water follows along with the wire to the next foil strip on the lower side thereof, and at the front edge of that next foil strip the water is scraped off. This scraping off of water gives rise to a pressure pulse, which is directed upward against the wire, and to the web already formed and lying on the wire. The size of this pressure pulse is a function of the amount of water scraped off, the scrape angle, and the wire speed. For these reasons already mentioned, a state of flocculations which is unacceptable for paper formation exists in the stock flowing out of the head box. The pressure pulses produced at the front edge of the foil strips introduce shear stresses into the stock on the wire, and these stresses create a positive deflocculation effect at an early state in the web formation. This effect, however, is difficult to control, and if the pressure pulses are too strong at a somewhat later stage in the web formation the fiber network already formed on the wire can be destroyed, thereby negatively affecting the web formation.

Various methods and constructions have been proposed for solving these problems. It is known, for example, to apply a slice on a head box in such a manner that an upper slice lip extends forward over the wire in its direction of movement and over a dewatering member located beneath the wire. The intention of this is to establish a converging space adapted to the dewatering rate between the upper lip and the wire, so that a constant stock flow can be maintained in this space. During the greater part of the dewatering process, this results in a stock layer which is well-defined by the extended upper lip and the wire, and in which hydrodynamic disturbances generated in the head box have no possibility of developing. The converging space between the extended upper lip and the wire can have a shape which is defined such that the upper lip is stiff and the wire is supported by a dewatering member, providing the wire with a given tension. The dewatering member may be a suction breast roll or a plane suction box (whose appearance may vary). The open area in the cover of the suction box may be a pattern of holes or slits extending transversely to the machine. All suction box covers, however, have the open area and land areas arranged so that the wire is supported in a manner which implies a minimum of deflection in the suction zones. Suction boxes can be divided into sections, so that varying vacuum levels can be applied in the different sections. By this arrangement, the dewatering rate can be controlled so as to be adapted to the converging forming space. However, as mentioned before with reference to foils, a support beneath the wire during a dewatering phase implies that pressure pulses are directed upward against the wire, and a degradation effect on the web formed can again result. The situation is additionally aggravated by the fact that the fiber network formed is also not exposed to stabilizing suction forces above the land areas.

It is therefore an object of the present invention to eliminate, to the greatest possible extent, the aforesaid drawbacks arising in connection with paper web formation.

SUMMARY OF THE INVENTION

In accordance with the present invention, these and other objects have been achieved by having the formation of the web take place in the space between a flexible upper lip projecting from the slice and a portion of the wire which is unsupported at least at the end of the formation of the paper web. In particular, in accordance with the method of the present invention, a paper web is formed from a fiber suspension by injecting a stream of the fiber suspension through a slice opening into the upper surface of the travelling paper web-forming surface, maintaining the travelling paper web-forming surface free of support for a predetermined distance downstream of the slice opening, maintaining a flexible lip proximate to the upper surface of the travelling paper web-forming surface and spaced therefrom for only a portion of the predetermined distance, and applying a vacuum to the lower surface of the travelling paper web-forming surface throughout that predetermined distance, so that the paper web is at least partially formed and the fiber suspension is substantially dewatered within that space between the flexible lip and the travelling paper web-forming surface, and disturbances during formation of the paper web throughout the predetermined distance are substantially reduced.

In accordance with the apparatus of the present invention, paper webs are formed from a fiber suspension by apparatus including a travelling paper web-forming surface including an upper surface and a lower surface, the travelling paper web-forming surface being free of support for a predetermined distance therealong, head box means including a slice opening for injecting a stream of fiber suspension onto the upper surface of the travelling paper web-forming surface at a point upstream of the predetermined distance, flexible lip means projecting from the slice opening and proximate to only a portion of the predetermined distance of the travelling paper web-forming surface, thus creating a paper web-forming space therebetween, and suction box means providing suction to the lower surface of the travelling paper web surface throughout that predetermined distance, thereby at least partially forming the paper web and substantially dewatering the fiber suspension in the paper web-forming space, and substantially reducing disturbances during formation of the paper web and throughout the predetermined distance.

Since at least the end of the formation of the paper web takes place in the space between a flexible upper lip and the unsupported portion of the wire, the hydrodynamic disturbances therein are damped, and a more uniform substance of the paper web can thus be maintained. The converging forming space hereof automatically adapts itself to the mode of the dewatering process. The concentration of the stock in the head box can be increased without interfering with the formation process. This is especially advantageous in connection with the production of paper having a high bulk. Dewatering is affected by vacuum maintained on the lower surface of the wire during paper web-formation. Since the unsupported wire portion extends past the flexible upper lip while the vacuum is still maintained, no disturbances arise in the paper web when it leaves the forming space. The liquid film which develops between the flexible upper lip and the web is sucked or drawn down into the web as soon as the web leaves the forming space.

In addition, beyond providing for undisturbed web-formation, the present invention also makes it possible to generate high dewatering capacity. This, in turn, implies the possibility of shortening the entire wire section of the paper making machine in general.

The present invention can also be applied to the production of multi-layer paper, where the stock is transferred to the wire through two or more slices, and where preferably a flexible upper lip is provided at the upper portion of each of such slices in a manner such that the upper lip for each of the higher layers extends past the upper lip for each layer lying there below.

BRIEF DESCRIPTION OF THE DRAWINGS

In order that the present invention be more fully understood, reference is made to the following drawings and detailed descriptions referring thereto, in which the drawings are as follows.

DETAILED DESCRIPTION

Figure 1:
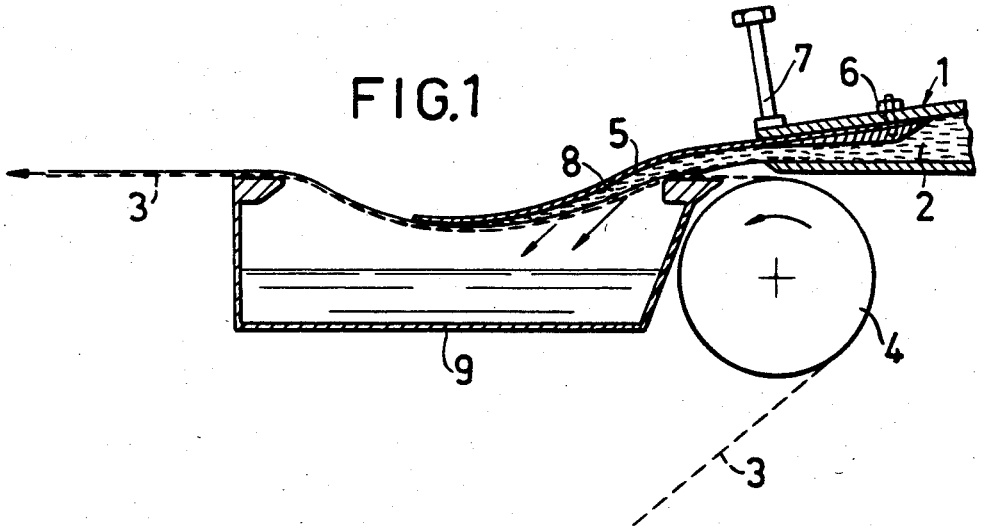
FIG. 1 is a side, elevational, sectional view of one embodiment of the apparatus of the present invention.

Making specific reference to the figures, in which like numerals refer to like portions thereof, FIG. 1 shows a slice 1 on a head box (not shown). The stock 2 is ejected through slice 1 onto a wire 3 which passes over a breast roll 4. A flexible upper lip 5 extends from the upper portion of the slice 1, and is attached to the slice by fastening means 6. The slice opening can be adjusted by setting means 7. The slice 1 is to be directed so as to form a small angle between the stock jet and the wire 3, which angle will preferably be less than about 15°.

Between the flexible upper lip 5 and the wire 3, a forming space 8 for the paper web is formed. Beneath this space 8 is located a suction box 9 which extends across the entire width of the web, and which is upwardly open, so that the wire passes unsupported over the suction box 9. Suction box 9, as well as the unsupported wire portion, extend through a predetermined distance past the upper lip 5. The length of this excess distance should be at least about 10% of the length of the forming space.

Since there is a vacuum in suction box 9, the stock 2 is rapidly dewatered in the forming space 8. The vacuum in suction box 9 should be between about 0.2–1.0 m water-column, and preferably about 0.5 m water-column.

Due to the controlled formation of the paper web in the space between the flexible upper lip 5 and the unsupported wire portion, the stock concentration in the head box can be maintained within about 0.1–1.0%, and preferably within about 0.3–0.8%, when paper with a low substance is being made, and within about 1.0–2.0%, and preferably about 1.3–1.7% during the manufacture of a pulp sheet.

Figure 2:
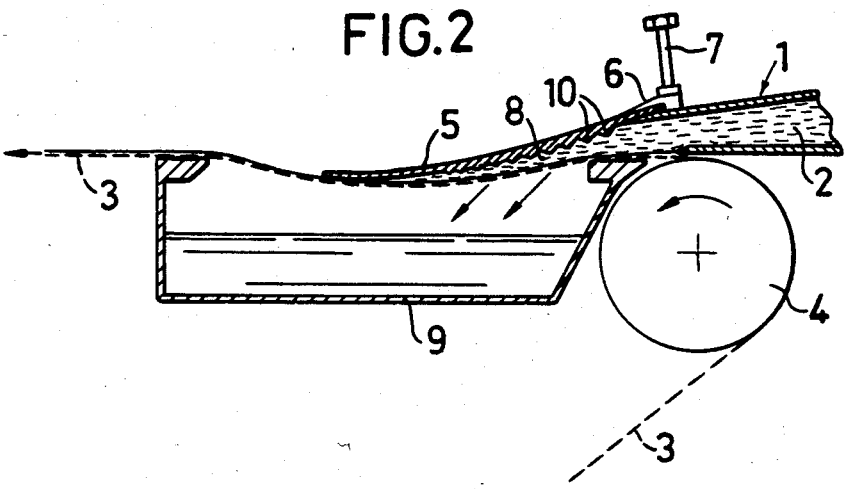
FIG. 2 is a side, elevational, sectional view of another embodiment of the apparatus of the present invention.

The flexible upper lip 5 shown in FIG. 1 has a smooth lower surface. In order to increase the micro-turbulence in the stock in the initial part of the forming space 8, the lower surface of the upper lip 5 can be provided with unevenness 10, as shown in FIG. 2, which thus introduces shear forces into the flow. These forces have a deflocculation effect on the stock, and thus further improve the web formation. In accordance with FIG. 2, the upper lip 5 is attached in a manner such that lip exchange can be carried out in a simple and rapid manner.

Figure 3:
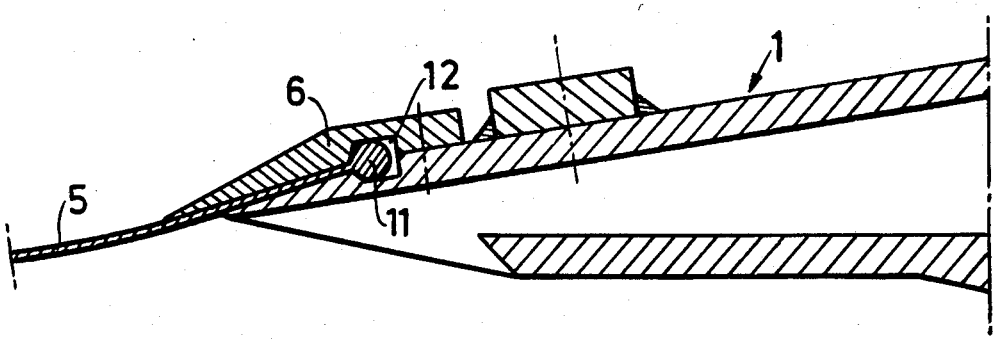
FIG. 3 is a side, elevational view of a section of another embodiment of the apparatus of the present invention, particularly showing the slice opening thereof.

FIG. 3 shows a further embodiment of slice 1, in this case where the flexible upper lip 5 is provided along the attached edge with a thickened portion 11, which fits into a groove 12 in the fastening means 6. Groove 12 extends along the entire width of the slice 7 and thus simplifies exchange of the upper lip 5.

Figure 4:
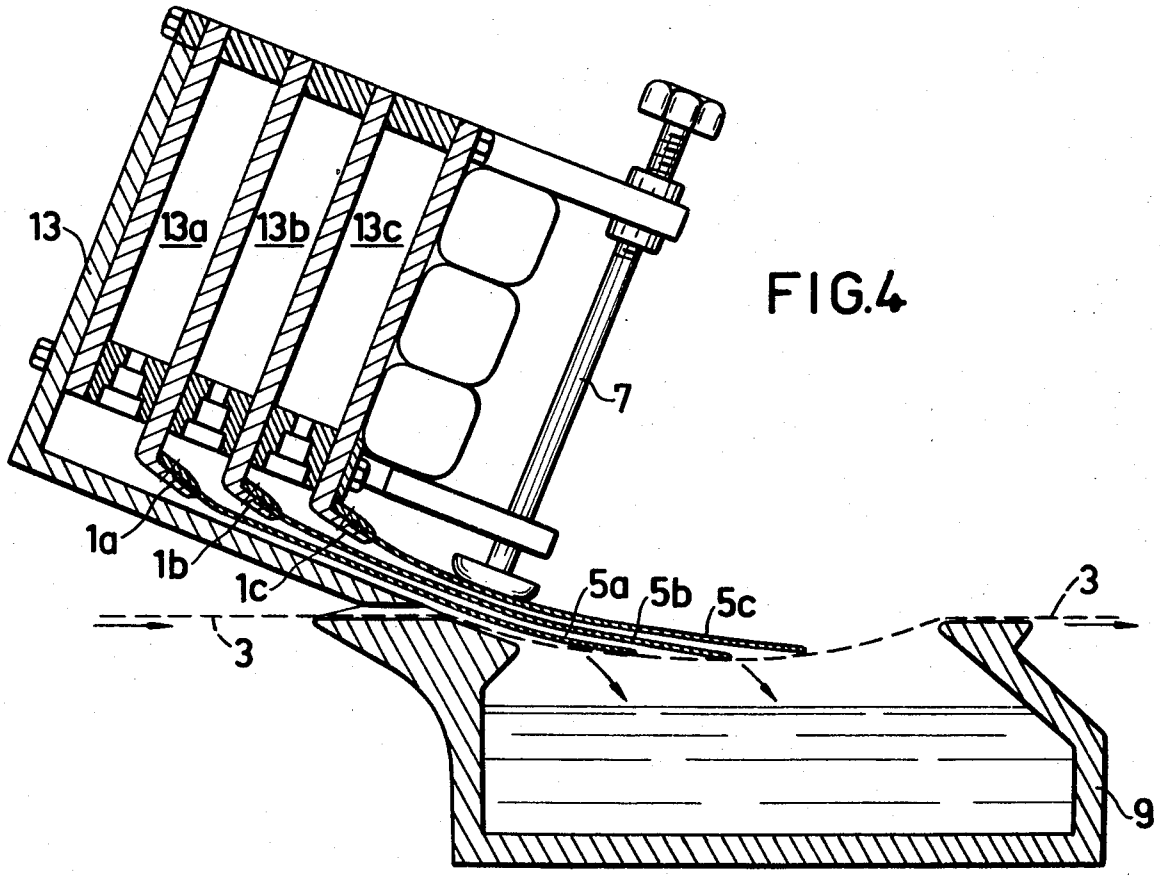
FIG. 4 is a side, elevational, partial sectional view of another embodiment of the apparatus of the present invention for making multi-layered papers.

FIG. 4 shows an embodiment of this invention for making multi-layered paper. In this case, the head box 13 is formed with three chambers 13*a, b* and *c,* having three respective slices 1*a, b* and *c,* each of which is provided with a flexible upper lip, 5*a, b* and *c.* The lowermost upper lip 5*a* extends through a distance beyond the unsupported portion of the wire 3. Central upper lip 5*b* extends through an additional distance past upper lip 5*a,* and uppermost upper lip 5*c* extends through a still further distance past upper lip 5*b.* The device can thus be accordingly designed to accommodate any number of additional layers for the paper web.

Figure 5:
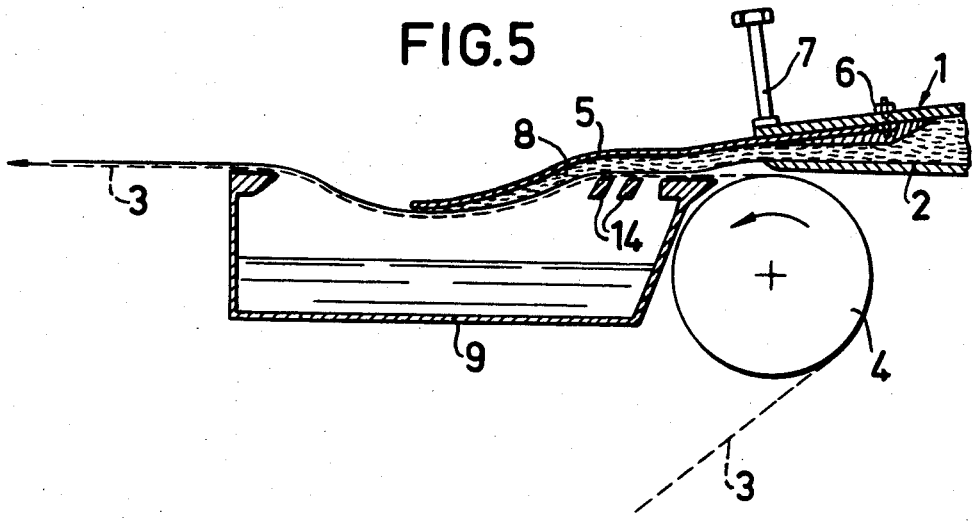
FIG. 5 is a side, elevational, sectional view of another embodiment of the apparatus of the present invention.

FIG. 5 shows a further embodiment of the invention which, like the embodiment of FIG. 2, produces increased microturbulence in the stock at the beginning of the forming space. According to this embodiment, a number of dewatering strips 14 is arranged under the wire at the beginning of the suction zone. The function of the strips 14 is to introduce hydrodynamic shear fields in the flow adjacent to the wire 3. These have a deflocculating effect on the stock. At the same time, the already formed fiber network will be loosened, which facilitates the continued dewatering thereof.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

We claim:

1. A method of forming a paper web from a fiber suspension comprising injecting a stream of said fiber suspension through a slice opening onto an upper surface of a travelling paper web-forming surface; maintaining said travelling paper web-forming surface free of support for a predetermined distance downstream of said slice opening, said predetermined distance including a first end and a second end, said first end being substantially adjacent to said slice opening; maintaining a flexible lip proximate to said upper surface of said travelling paper web-forming surface and spaced therefrom for only a portion of said predetermined distance; and applying a vacuum to the lower surface of said travelling paper web-forming surface throughout said predetermined distance, whereby said paper web is substantially entirely formed and said fiber suspension is substantially dewatered within said space between said flexible lip and said travelling paper web-forming suspension, said vacuum is applied to said lower surface of said travelling paper web-forming surface for a distance beyond said flexible lip so as to further dewater said fiber suspension, and disturbances during the formation of said paper web and throughout said predetermined distance are substantially reduced.

2. The method of claim 1 including creating microturbulence in said fiber suspension during the initial portion of said formation of said paper web within said space between said flexible lip and said travelling paper web-forming surface, said flexible lip extending well beyond the location at which said microturbulence is created in said fiber suspension.

3. The method of claim 1 including injecting a plurality of streams of said fiber suspension onto said upper surface of said travelling paper web-forming surface, and maintaining a plurality of said flexible lips proximate to said upper surface of said travelling paper web-forming surface, each of said plurality of flexible lips corresponding to one of said plurality of streams of fiber suspension and corresponding to increasing portions of said portion of said predetermined distance corresponding to said space between said flexible lip and said travelling paper web-forming suspension, thereby forming a paper web comprising several layers.

4. Apparatus for forming a paper web from a fiber suspension comprising a travelling paper web-forming surface including an upper surface and a lower surface, said travelling paper web-forming surface being free of supports for a predetermined distance therealong, said predetermined distance including a first portion and a second portion; head box means including a slice opening located substantially adjacent to said predetermined distance for injecting a stream of said fiber suspension onto said upper surface of said travelling paper web-forming surface at a point upstream of said predetermined distance; flexible lip means projecting from said slice opening and proximate to only said first portion of said predetermined distance of said travelling paper web-forming surface, thereby creating a paper web-forming surface therebetween; and suction box means providing suction to said lower surface of said travelling paper web-forming surface throughout said first and second portions of said predetermined distance, thereby substantially entirely forming said paper web and substantially dewatering said fiber suspension within said paper web-forming space, further dewatering said fiber suspension in the portion of said suction box means corresponding to said second portion of said travelling web-forming surface, and substantially reducing disturbances during the formation of said paper web and throughout said predetermined distance.

5. The apparatus of claim 4 wherein said paper web-forming space comprises a first section of said predetermined distance of said travelling paper web-forming surface, and the remaining portion of said predetermined distance downstream from said flexible lip means comprises a second section of said predetermined distance, and wherein said second section of said predetermined distance comprises a distance of at least 10% of said first section of said predetermined distance.

6. The apparatus of claim 4 wherein said flexible lip means includes a smooth lower surface in contact with said paper web-forming space.

7. The apparatus of claim 4 wherein said flexible lip means includes microturbulence forming means on the lower surface thereof in contact with an initial portion of said paper web-forming space, said flexible lip means extending well beyond the location of said microturbulence forming means.

8. The apparatus of claim 4 including dewatering strips in contact with said lower surface of said travelling paper web-forming surface at the initial portion of said paper web-forming surface and immediately prior to said predetermined distance.

9. The apparatus of claim 4 including a plurality of said slice openings for injecting a plurality of streams of said fiber suspension onto said upper surface of said travelling paper web-forming surface, and a plurality of said flexible lip means projecting from corresponding ones of said plurality of slice openings and proximate to increasing portions of said portion of said predetermined distance of said travelling paper web-forming surface, thereby forming a paper web comprising several layers.

* * * * *